US010913267B2

(12) United States Patent
Kaneko et al.

(10) Patent No.: US 10,913,267 B2
(45) Date of Patent: Feb. 9, 2021

(54) METHOD OF CONTROLLING LIQUID EJECTING APPARATUS AND LIQUID EJECTING APPARATUS

(71) Applicant: SEIKO EPSON CORPORATION, Tokyo (JP)

(72) Inventors: Tomoshige Kaneko, Minamiminowa-Mura (JP); Hiroaki Okui, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/453,861

(22) Filed: Jun. 26, 2019

(65) Prior Publication Data

US 2019/0389201 A1 Dec. 26, 2019

(30) Foreign Application Priority Data

Jun. 26, 2018 (JP) ..... 2018-120535

(51) Int. Cl.
*B41J 2/045* (2006.01)

(52) U.S. Cl.
CPC ..... *B41J 2/0457* (2013.01); *B41J 2/04581* (2013.01)

(58) Field of Classification Search
CPC .. B41J 2/0457; B41J 2/04581; B41J 2/04583; B41J 2/04596; B41J 2/04598
See application file for complete search history.

(56) References Cited

U.S. PATENT DOCUMENTS 8,562,117 B2 * 10/2013 Limb ..... B41J 2/17593 347/88
10,427,401 B2 * 10/2019 Garcia Alvarez ..... B41J 2/0454
2009/0066747 A1 3/2009 Hays et al.

FOREIGN PATENT DOCUMENTS

JP 2009061779 3/2009

* cited by examiner

*Primary Examiner* — Thinh H Nguyen
(74) *Attorney, Agent, or Firm* — Workman Nydegger

(57) ABSTRACT

A method of controlling a liquid ejecting apparatus that includes a liquid ejecting head having nozzles configured to eject a liquid, pressure chambers communicating with the nozzles, and drive elements configured to change the volume in the pressure chambers, and a drive-waveform generating circuit configured to generate a drive waveform for driving the drive elements to vibrate the liquid in the nozzles is provided. The method includes detecting a power-off operation for issuing an instruction for turning off an electric power of the liquid ejecting apparatus and vibrating the liquid by driving piezoelectric elements by the drive waveform in response to detecting the power-off operation by the detecting.

7 Claims, 10 Drawing Sheets

METHOD OF CONTROLLING LIQUID EJECTING APPARATUS AND LIQUID EJECTING APPARATUS

The present application is based on, and claims priority from JP Application Serial Number 2018-120535, filed Jun. 26, 2018, the disclosure of which is hereby incorporated by reference herein in its entirety.

BACKGROUND

1. Technical Field

The present disclosure relates to a method of controlling a liquid ejecting apparatus capable of reducing damage to components caused by freeze of liquid in a liquid flow path and a liquid ejecting apparatus.

2. Related Art

Liquid ejecting apparatuses have a liquid ejecting head and eject (discharge) various kinds of liquids from the liquid ejecting head. Examples of the liquid ejecting apparatuses include image recording apparatuses such as ink jet printers and ink jet plotters. In recent years, the liquid ejecting apparatuses have been applied to various manufacturing apparatuses by taking advantage of the ability to accurately eject a very small amount of liquid to predetermined positions. For example, the liquid ejecting apparatuses are applied to display-manufacturing apparatuses for manufacturing color filters for liquid crystal displays and the like, electrode-forming apparatuses for forming electrodes for organic electro luminescence (EL) displays, field emission displays (FEDs), and the like, and chip-manufacturing apparatuses for manufacturing biochips (biochemical elements). Recording heads for image recording apparatuses eject liquid inks, and color material ejecting heads for manufacturing displays eject solutions of coloring materials of red (R), green (G), and blue (B). Electrode-material ejection heads for electrode-forming apparatuses eject liquid electrode materials, and bioorganic-compound ejecting heads for chip-manufacturing apparatuses eject solutions of bioorganic compounds.

Such a liquid ejecting head has a liquid path that extends from a common liquid chamber (may be referred to as a reservoir or a manifold) through a pressure chamber (may be referred to as a pressure generating chamber or a cavity) to a nozzle. The liquid ejecting head generates pressure fluctuations in the liquid in the pressure chamber by driving an actuator such as a piezoelectric element and ejects the liquid from the nozzle as droplets by the pressure fluctuations. In a general liquid ejecting apparatus having a liquid ejecting head, depending on the installation environment, the liquid in internal flow path in the liquid ejecting head may freeze. The frozen liquid in the liquid path may cause breakage of the components of the liquid ejecting head due to the volume expansion by freeze. Cracks are likely to be produced, in particular, in walls that define high-density pressure chambers. To solve the problem, there has been proposed a structure for discharging a liquid from a component, such as the above-described pressure chamber, that may be broken due to freeze in an environment in which there is a possibility of liquid freeze (for example, see JP-A-2009-061779).

The structure in which the liquid is moved and discharged from the component that may be broken due to freeze, however, requires a component such as a pump for increasing or reducing the pressure in the liquid flow path to move the liquid, resulting in an increase in size and complexity of the apparatus. Furthermore, such a structure replaces the liquid in the liquid flow path with air, and thus air bubbles tend to mix with the liquid when the liquid flow path is refilled with the liquid. These air bubbles may cause a failure such as poor liquid ejection from the nozzle.

SUMMARY

The present disclosure is directed to a method of controlling a liquid ejecting apparatus capable of reducing damage to components caused by freeze of liquid in a liquid flow path and a liquid ejecting apparatus.

According to an aspect of the present disclosure, a method of controlling a liquid ejecting apparatus that includes a liquid ejecting head having nozzles configured to eject a liquid and drive elements configured to generate pressure fluctuations in liquid chambers communicating with the nozzles is provided. The method includes detecting a power-off operation for issuing an instruction for turning off an electric power of the liquid ejecting apparatus and driving the drive elements to the extent the liquid is not ejected from the nozzles in response to detecting the power-off operation by the detecting.

DESCRIPTION OF EXEMPLARY EMBODIMENTS

Hereinafter, embodiments of the disclosure will be described with reference to the attached drawings. Although the following embodiments describe various limitations as preferred embodiments of the disclosure, it is to be understood that the scope of the disclosure is not limited to the embodiments unless otherwise specifically described to limit the disclosure in the following description. In the following description, as an example liquid ejecting apparatus according to embodiments of the disclosure, an ink jet recording apparatus (hereinafter, referred to as a printer) will be described.

Figure 1:
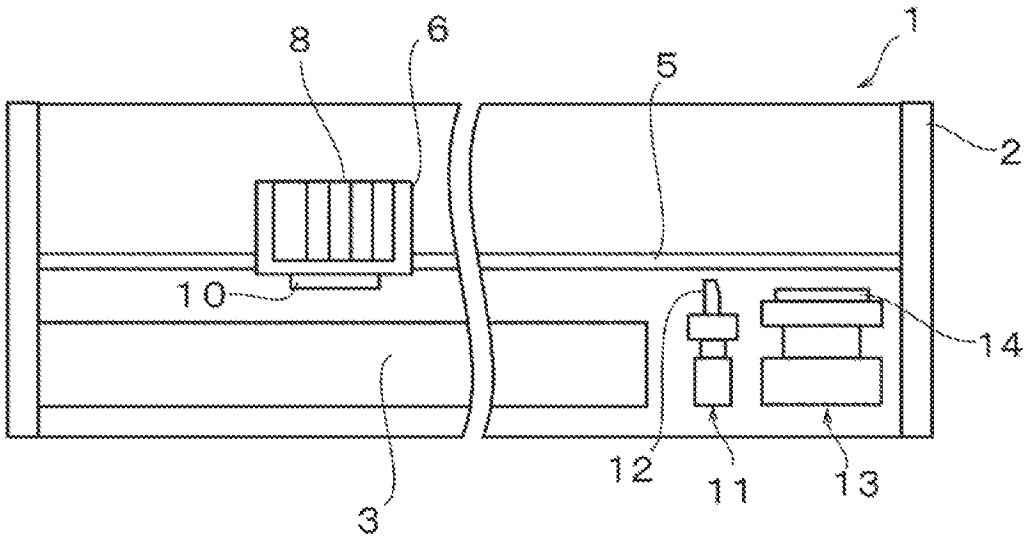
FIG. 1 is a front view of a structure of a liquid ejecting apparatus according to an embodiment.
Figure 2:
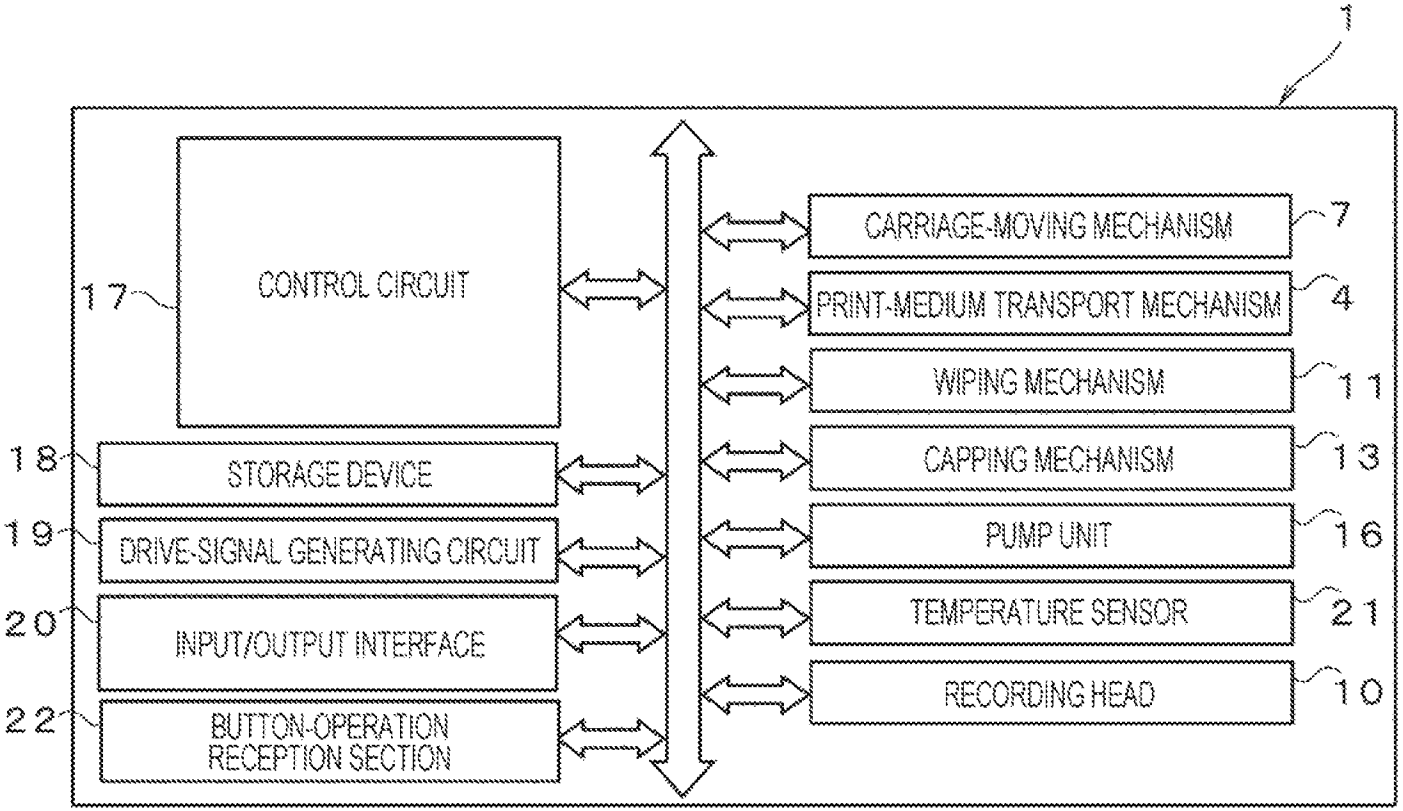
FIG. 2 is a block diagram illustrating an electric configuration of a liquid ejecting apparatus.

FIG. 1 is a front view of a structure of a printer 1 according to an embodiment, the printer 1 including a recording head 10 that is a liquid ejecting head. FIG. 2 is a block diagram illustrating an electric configuration of the printer 1. The printer 1 includes a frame 2 and a platen 3 that is provided in the frame 2. A print medium such as a recording sheet, a cloth, or a resin sheet is transported on the platen 3 by a print-medium transport mechanism 4 (see FIG. 2). In the frame 2, a guide rod 5 is provided in parallel with the platen 3. The guide rod 5 slidably supports a carriage 6 on which the recording head 10 is mounted. The carriage 6 reciprocates along the guide rod 5 in main scanning directions that are orthogonal to a transport direction of a print medium with a driving force from a carriage-moving mechanism 7 (see FIG. 2). While the printer 1 reciprocating the carriage 6 along the main scanning axis with respect to a print medium mounted on the platen 3, the printer 1 ejects an ink (a liquid according to the embodiment) from nozzles 30 (see FIG. 3) of the recording head 10 to form (record or print) an impact pattern such as texts or images with dot arrays formed by the ink ejected onto the print medium.

To the cartridge 6, an ink cartridge 8 that stores an ink is detachably attached. Example inks include inks having various known compositions, for example, a water-based dye ink, a water-based pigment ink, an organic solvent-based (eco-solvent-based) ink having weather resistance higher than that of the water-based inks, or a photo-curable ink that cures with ultraviolet rays. Although the ink cartridge 8 is mounted on the carriage 6 in this embodiment, the structure is not limited to this example. For example, the ink cartridge 8 may be provided on a body side of the printer 1, and the ink may be supplied to the recording head 10 via an ink supply tube.

In a home position that is a non-printing area of the printer 1, a wiping mechanism 11 that wipes a nozzle-formed surface (a surface that faces the platen 3 in the recording head 10) on which the nozzles 30 are formed in the recording head 10 is provided. The wiping mechanism 11 includes a wiper 12 that serves as a wiping member. The wiper 12 may be an elastic flexible member such as rubber or elastomer. The wiping mechanism 11 sets the wiper 12 to a position where the tip end of the wiper 12 can come into contact with the nozzle-formed surface of the recording head 10 during a wiping operation. When the wiper 12 and the nozzle-formed surface are relatively moved with the tip end of the wiper 12 being in contact with the nozzle-formed surface, the nozzle-formed surface is wiped by the wiper 12.

Adjacent to the wiping mechanism 11, a capping mechanism 13 is disposed in the home position or near the home position. The capping mechanism 13 has a cap 14 that is a sealing member that seals the nozzle-formed surface of the recording head 10. The cap 14 is a tray-shaped member made of an elastic material such as an elastomer and has a bottom. An upper surface of the cap 14, that is, a surface that faces the nozzle-formed surface is open. In a state in which the nozzle-formed surface is sealed (in a capping state), an internal space of the cap 14 serves as a sealed space, and the nozzles 30 are disposed within the opening of the sealed space. To the cap 14, a pump unit 16 is connected (see FIG. 2), and the pressure in the sealed space in the cap 14 can be reduced by an operation of the pump unit 16. In a cleaning operation for cleaning clogging of the nozzles 30 of the recording head 10 or an ink flow path, when the pump unit 16 is operated to reduce the pressure in the sealed space, the ink and air bubbles in the recording head 10 are sucked from the nozzles 30 and discharged into the sealed space of the cap 14. When the electric power of the printer 1 is turned off, the recording head 10 is positioned in the home position, and a capping operation is performed to the nozzle-formed surface of the recording head 10 by the capping mechanism 13. In an environment in which the ink in the recording head 10 is likely to freeze, the printer 1 according to the embodiment performs an anti-freezing micro-vibration operation for evaporating a solvent such as water in an ink in the recording head 10 before a capping operation is performed in response to a power shutdown. This processing will be described in detail below.

As illustrated in FIG. 2, the printer 1 according to the embodiment includes a control circuit 17, a storage device 18, a drive-signal generating circuit 19 (corresponding to a drive-waveform generating circuit according to the embodiment), an input and output interface 20, a button-operation reception section 22, the print-medium transport mechanism 4, the carriage-moving mechanism 7, the wiping mechanism 11, the capping mechanism 13, the pump unit 16, a temperature sensor 21, and the recording head 10.

The control circuit 17 is a processing device for performing overall control of the printer and controls a printing operation (operation of ejecting a liquid that is an original function of the printer 1) by the recording head 10 and other operations. The storage device 18 is a device for storing a program for the control circuit 17 and data that is used for various control operations, and may include a read-only memory (ROM), a random access memory (RAM), and a nonvolatile RAM (NVRAM). The drive-signal generating circuit 19 generates a drive signal that includes a drive pulse for driving a piezoelectric element 31 in the recording head 10 based on waveform data about a waveform of the drive signal. The input and output interface 20 sends and receives various types of data, for example, receives a request for a printing operation, print setting information, print data, or the like from an external device, and outputs information about a status of the printer 1 to an external device. In this embodiment, via a wired or wireless network, an outside air temperature (example temperature information according to the embodiment) is obtained from weather data or other data of the area where the printer 1 is installed. The temperature sensor 21 detects a temperature inside the printer 1, specifically, around the recording head 10, and outputs the detected temperature (example temperature information according to the embodiment) to the control circuit 17. The input and output interface 20 and the temperature sensor 21 serve as a temperature information obtaining unit that obtains temperature information about a temperature in the environment in which the printer 1 is installed. The button-operation reception section 22 electrically detects an input operation by a user through a power button (not illustrated) that is provided on an exterior of the printer 1, and outputs a detection signal that corresponds to the operation to the control circuit 17. The button-operation reception section 22 may serve as an off-operation detection unit that detects a power-off operation and issues an instruct for turning off the electric power of the printer 1 or an on-operation detection unit that detects a power-on operation and issues an instruct for turning on the electric power of the printer 1.

Figure 3:
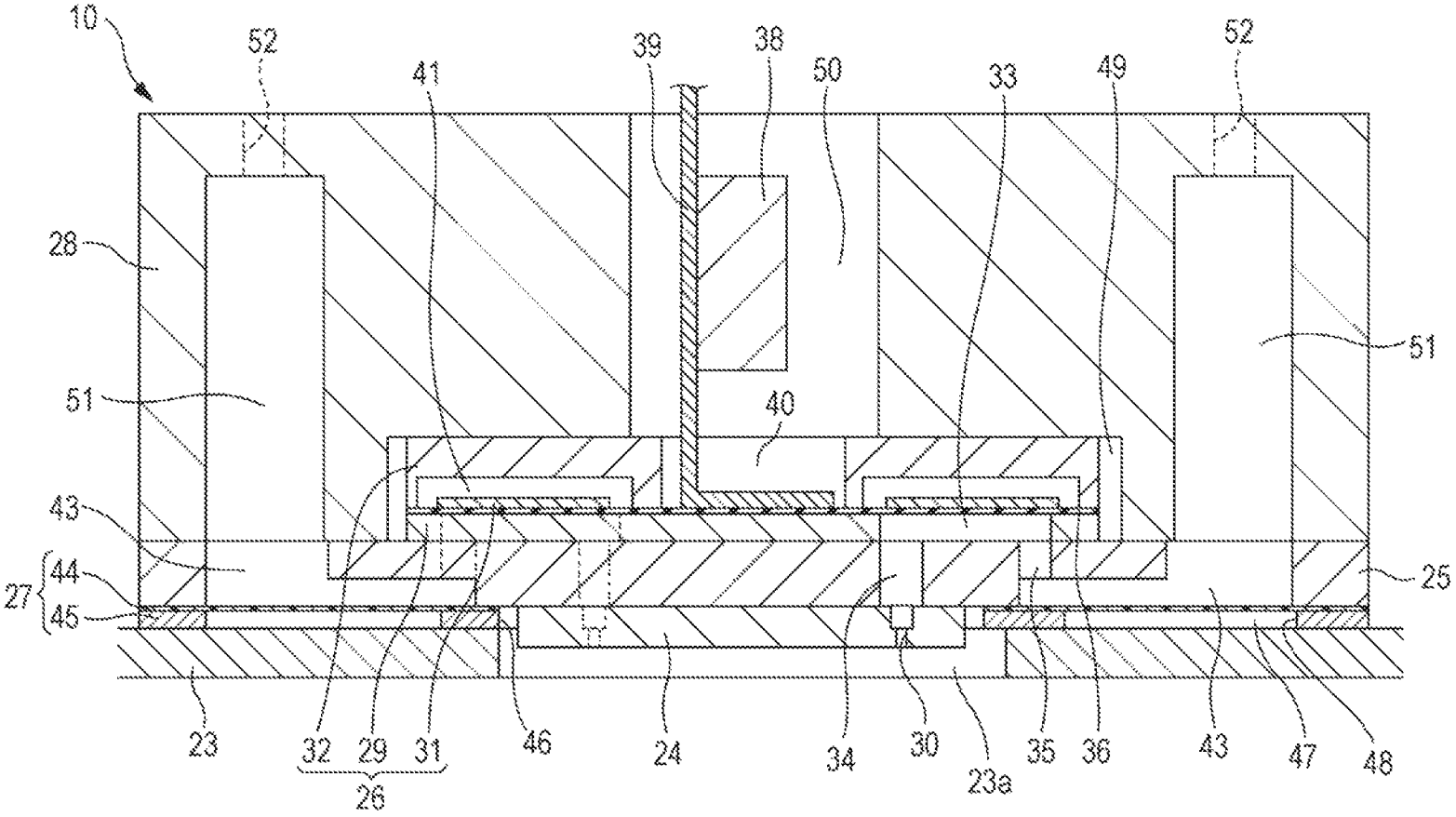
FIG. 3 is a cross-sectional view of a liquid ejecting head.

FIG. 3 is a cross sectional view of the recording head 10 according to the embodiment. The recording head 10 according to the embodiment has a plurality of head components laminated and bonded by an adhesive or the like such as a fixing plate 23, a nozzle plate 24, a communication plate 25, an actuator unit 26, a compliance substrate 27, and a holder 28. In the description below, a lamination direction of the components of the recording head 10 is referred to as a vertical direction as necessary.

The actuator unit 26 according to the embodiment has a pressure-chamber forming substrate 29, piezoelectric elements 31, and a protection substrate 32 that are laminated as a unit. The pressure-chamber forming substrate 29 has a plurality of pressure chambers 33 that respectively communicate with a plurality of nozzles 30 formed in the nozzle plate 24. Each piezoelectric element 31 serves as a drive element that causes pressure fluctuations in the ink in each pressure chamber 33. The protection substrate 32 protects the pressure-chamber forming substrate 29 and the piezoelectric elements 31. A wiring space 40 in which a flexible circuit 39, on which a drive integrated circuit (IC) 38 is mounted, is inserted is provided at a central portion of the protection substrate 32. Lead electrodes of the piezoelectric elements 31 are provided in the wiring space 40 and to the lead electrodes, lead terminals of the flexible circuit 39 are electrically connected. Via the flexible circuit 39, a drive signal sent from the drive-signal generating circuit 19 is applied to the piezoelectric elements 31. The flexible circuit 39 is not limited to the flexible circuit 39 that has the drive IC 38; alternatively, a flexible circuit on which the drive IC 38 is provided as a separate component via a so-called interposer in an upper part of the protection substrate 32 may be employed.

The pressure-chamber forming substrate 29 in the actuator unit 26 is made of a silicon single crystal substrate. In the pressure-chamber forming substrate 29, liquid chambers that serve as the pressure chambers 33 are arranged in line to correspond to the nozzles 30, forming a plurality of arrays. The pressure chamber 33 is a liquid chamber long in a direction intersecting the nozzle arrays. An end portion of the pressure chamber 33 on one side in the longitudinal direction communicates with a nozzle communication port 34, and an end portion on the other side communicates with an individual communication port 35. In the pressure-chamber forming substrate 29 according to the embodiment, two arrays of the pressure chambers 33 are provided.

A diaphragm 36 is laminated on an upper surface (surface opposite to the surface on the communication plate 25 side) of the pressure-chamber forming substrate 29. The diaphragm 36 seals an upper opening of each pressure chamber 33. Specifically, the diaphragm 36 defines a part of the pressure chamber 33. The diaphragm 36 includes, for example, an elastic film composed of silicon dioxide ($SiO_2$) formed on the upper surface of the pressure-chamber forming substrate 29, and an insulating film composed of zirconium oxide ($ZrO_2$) formed on the elastic film. In areas corresponding to the pressure chambers 33 on the diaphragm 36, the piezoelectric elements 31 are laminated respectively.

The piezoelectric element 31 according to the embodiment is a so-called flexure mode piezoelectric element. The piezoelectric element 31 includes, for example, a lower electrode layer, a piezoelectric layer, and an upper electrode layer (not shown) that are sequentially laminated on the diaphragm 36. The piezoelectric element 31 having such a structure bends and deforms in the vertical direction when an electric field corresponding to the potential difference between the electrodes is applied between the lower electrode layer and the upper electrode layer. In this embodiment, two arrays of piezoelectric elements 31 are provided to correspond to the two arrays of the pressure chambers 33. The lower electrode layers and the upper electrode layers extend from the arrays of the piezoelectric elements 31 on both sides into the wiring space 40 as the lead electrodes, and electrically connected to the flexible circuit 39 as described above.

The protection substrate 32 is laminated on the diaphragm 36 so as to cover the two arrays of the piezoelectric elements 31. In the protection substrate 32, a long accommodating space 41 capable of accommodating the array of the piezoelectric elements 31 is formed. The accommodating space 41 is a cavity formed from the lower surface side of the protection substrate 32, that is, from the diaphragm 36 side to the upper surface side, that is, toward the holder 28 side halfway to the height direction of the protection substrate 32. In the protection substrate 32 according to the embodiment, the accommodating spaces 41 are formed on both sides of the wiring space 40. To the lower surface of the actuator unit 26, the communication plate 25 that has an area wider than that of the actuator unit 26 is joined.

The communication plate 25 is made of a silicon single crystal substrate similarly to the pressure-chamber forming substrate 29. In the communication plate 25 according to the embodiment, the nozzle communication port 34 that communicates with the pressure chamber 33 and the nozzle 30, a reservoir 43 that is commonly provided in each pressure chamber, and the individual communication port 35 that communicates with the reservoir 43 and the pressure chamber 33 are formed, for example, by anisotropic etching. The reservoir 43 is a liquid chamber that extends along the nozzle array direction. In the communication plate 25 according to the embodiment, two reservoirs 43 are formed to correspond to the nozzle arrays in the nozzle plate 24. An opening of the reservoir 43 on a lower surface side is sealed by a compliance sheet 44 of the compliance substrate 27. Note that a plurality of reservoirs may be provided to one nozzle array, and inks of different types may be provided in the respective reservoirs. The reservoir 43 is formed by anisotropic etching from the lower surface side of the communication plate 25. Into the reservoir 43, an ink is introduced via an inlet 52 of an introduction liquid chamber 51 that is provided in the holder 28 as described below. A plurality of individual communication ports 35 are provided to correspond to the pressure chambers 33 respectively along the nozzle array direction. The individual communication port 35 communicates with the end portion on the other side (the side opposite to the side where the individual communication port 35 communicates with the nozzle communication port 34) of the pressure chamber 33 in the longitudinal direction.

In a substantially central part of the lower surface of the communication plate 25, the nozzle plate 24 in which the nozzles 30 are formed is joined. The nozzle plate 24 according to the embodiment is a plate that has a shape smaller than the communication plate 25 and the actuator unit 26 and is made of a silicon single crystal substrate. The nozzle plate 24 is bonded by an adhesive or the like to the lower surface of the communication plate 25 such that in an area other than the openings of the reservoirs 43 and the nozzle communication ports 34 are open, the nozzle communication ports 34 and the nozzles 30 communicate with each other. In the nozzle plate 24 according to the embodiment, a total of two nozzle arrays (nozzle groups) of the nozzles 30 arrayed in line are provided.

To the lower surface of the communication substrate 25, in an area other than the nozzle plate 24, the compliance substrate 27 is joined. The compliance substrate 27 seals the openings of the reservoirs 43 in the lower surface of the communication plate 25 in a state in which the compliance substrate 27 is positioned and joined to the lower surface of the communication plate 25. The compliance substrate 27 according to the embodiment includes the compliance sheet 44 and a support plate 45 that supports the compliance sheet 44, which are joined to each other. To the lower surface of the communication plate 25, the compliance sheet 44 of the compliance substrate 27 is joined such that the compliance sheet 44 is between the communication plate 25 and the support plate 45. The compliance sheet 44 is made of a flexible thin film, for example, a synthetic resin material such as polyphenylene sulfide (PPS). The support plate 45 is made of a metallic material such as stainless steel that has higher rigidity and is thicker than the compliance sheet 44. In an area facing the reservoir 43 in the support plate 45, a part of the support plate 45 is removed in a shape similar to the opening in the lower surface of the reservoir 43 to form a compliance opening 48. Accordingly, the opening of the reservoir 43 on the lower surface side is sealed only by the flexible compliance sheet 44. Consequently, the compliance sheet 44 defines a part of the reservoir 43.

A portion corresponding to the compliance opening 48 in the lower surface of the support plate 45 is sealed by the fixing plate 23. With such a structure, between the flexible area in the compliance sheet 44 and the fixing plate 23 that faces the compliance sheet 44, a compliance space 47 is formed. The flexible area in the compliance sheet 44 in the compliance space 47 deforms toward the reservoir 43 or the compliance space 47 by the pressure fluctuations in the ink flow path, in particular, in the reservoir 43. Accordingly, the thickness of the support plate 45 is determined based on a height required for the compliance space 47.

The holder 28 has substantially the same shape as the communication plate 25 in a plan view. On a lower surface side of the holder 28, an accommodating space 49 for accommodating the actuator unit 26 is provided. The lower surface of the holder 28 is sealed by the communication plate 25 with the actuator unit 26 being accommodated in the accommodating space 49. In a substantially central part of the holder 28 in a plan view, an insertion space 50 that communicates with the accommodating space 49 is open. The insertion space 50 also communicates with the wiring space 40 in the actuator unit 26. The flexible circuit 39 is inserted into the wiring space 40 through the insertion space 50. In the holder 28, on both sides of the insertion space 50 and the accommodating space 49, the introduction liquid chambers 51 that communicate with the reservoirs 43 in the communication plate 25 respectively are provided. On an upper surface of the holder 28, the inlets 52 that communicates with the introduction liquid chambers 51 respectively are open. Into the introduction liquid chamber 51, an ink sent from the ink cartridge 8 is introduced via the inlet 52. Specifically, the ink sent from the ink cartridge 8 is introduced into the inlet 52, the introduction liquid chamber 51, and the reservoir 43, and supplied from the reservoir 43 via the individual communication port 35 to each pressure chamber 33.

The fixing plate 23 is, for example, a metal plate of a stainless steel. The fixing plate 23 according to the embodiment has, in a location corresponding to the nozzle plate 24, a through hole 23*a* having a shape similar to the shape of the nozzle plate 24 and a shape open in the thickness direction so as to expose the nozzles 30 in the nozzle plate 24. As described above, the through hole 23*a* communicates with a through hole opening 46 in the compliance substrate 27. In this embodiment, the nozzle-formed surface is defined by the lower surface of the fixing plate 23 in the fixing plate 23 and the exposed portion of the nozzle plate 24 in the through hole 23*a*. The fixing plate 23 is fixed to a supporting member such as a case (not illustrated) that supports the recording head 10.

In the recording head 10 having the above-described structure, in a state in which the inside of the liquid flow paths from the introduction chambers 51 through the reservoirs 43 and the pressure chambers 33 to the nozzles 30 are filled with an ink, when the piezoelectric elements 31 are driven in accordance with a drive signal from the drive IC 38, pressure fluctuations are generated in the ink in the pressure chambers 33 and by the pressure fluctuations, the ink is ejected from predetermined nozzles 30.

Figure 4:
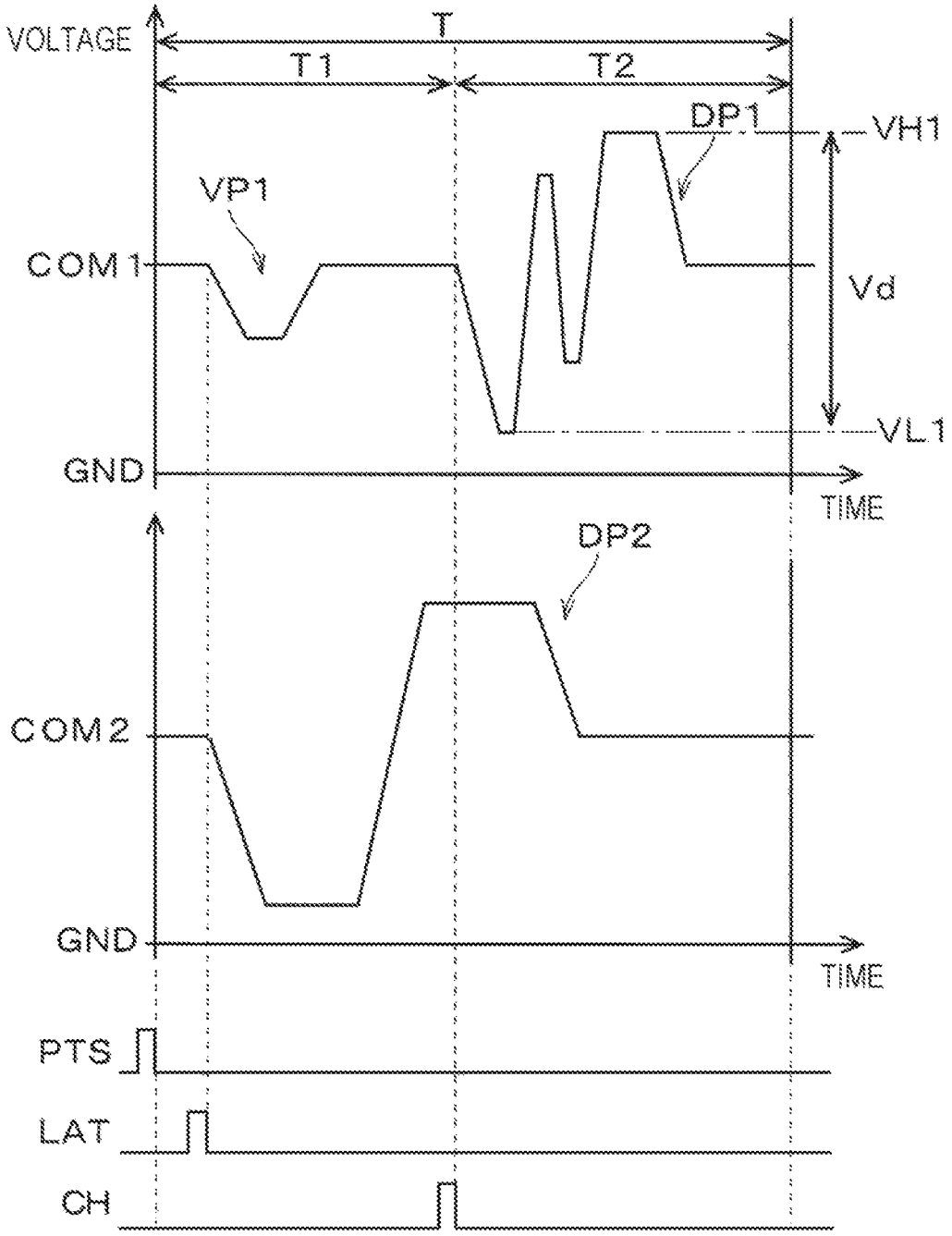
FIG. 4 illustrates example waveforms of print drive signals.

FIG. 4 illustrates example waveforms of print drive signals to be generated by the drive-signal generating circuit 19. The drive-signal generating circuit 19 according to the embodiment repeatedly generates a first print drive signal COM1 and a second print drive signal COM2 at every print unit cycle T that is defined by a timing signal PTS and a latch signal LAT that are generated based on scanning of the carriage 6 during a printing operation. The print unit cycle T according to the embodiment corresponds to one pixel of an image or the like to be printed on a print medium. With respect to the first print drive signal COM1, the print unit cycle T is divided into two periods T1 and T2 by a change signal CH. In the first period T1, a micro-vibration drive pulse VP1 is generated and in the second period T2, a first ejection drive pulse DP1 is generated. With respect to the second print drive signal COM2, in the print unit cycle T, a second ejection drive pulse DP2 is generated. During a printing operation, to each piezoelectric element 31, one of the drive pulses VP1, DP1, and DP2 is selectively applied.

Figure 5:
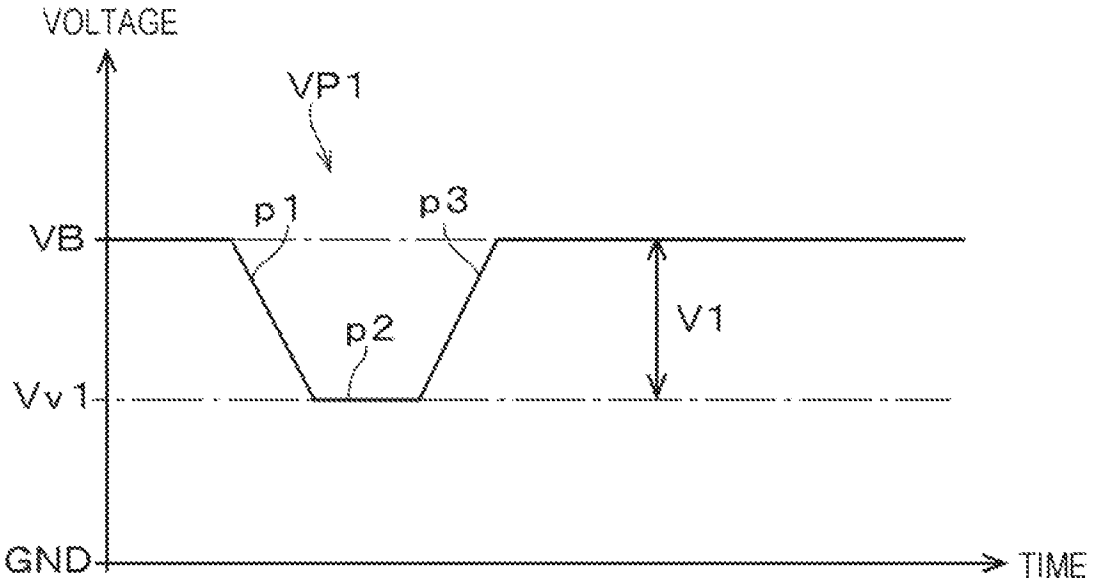
FIG. 5 illustrates an example waveform of a micro-vibration drive pulse.

FIG. 5 illustrates an example waveform of the micro-vibration drive pulse VP1. The micro-vibration drive pulse VP1 is a drive pulse for generating vibration (so-called micro vibration) in the ink in the pressure chambers 33 and in the nozzles 30 by causing pressure fluctuations in the ink in the pressure chambers 33 to an extent that the ink is not ejected from the nozzles 30. The micro-vibration drive pulse VP1 according to the embodiment has an inverted trapezoidal voltage waveform and has a first expansion element p1, a first hold element p2, and a first contraction element p3. The first expansion element p1 is a waveform element for decreasing a potential from a reference potential VB to a first micro-vibration potential Vv1 that is lower than the reference potential VB. The first hold element p2 is a waveform element for maintaining the first micro-vibration potential Vv1 that is a termination potential of the first expansion element p1 for a certain period of time. The first contraction element p3 is a waveform element for increasing a potential from the first micro-vibration potential Vv1 to the reference potential VB. When the micro-vibration drive pulse VP1 is applied to the piezoelectric element 31, first, by the first expansion element p1, the piezoelectric element 31 deforms from a reference state (initial state) that corresponds to the reference potential VB toward the outside (side separating from the nozzle plate 24) of the pressure chamber 33, and the pressure chamber 33 expands from a reference volume that corresponds to the reference potential VB to a first micro-vibration expansion volume that corresponds to the first micro-vibration potential Vv1. The expansion state of the pressure chamber 33 is maintained throughout the application period of the first hold element p2. Then, by the first contraction element p3, the piezoelectric element 31 deforms toward the inside (a side approaching the nozzle plate 24) of the pressure chamber 33, and the pressure chamber 33 returns from the first micro-vibration expansion volume, which corresponds to the first micro-vibration potential Vv1, to the reference volume. As described above, by the expansion of the pressure chamber 33 by the first expansion element p1 and the contraction of the pressure chamber 33 by the first contraction element p3, pressure fluctuations occur in the ink in the pressure chamber 33, thereby the ink in the pressure chamber 33 and the nozzle 30 is stirred.

The first ejection drive pulse DP1 in the first print drive signal COM1 is a drive pulse for causing the nozzle 30 to eject ink droplets corresponding to a smallest dot among dots that can be formed by the printer 1 onto a print medium. The second ejection drive pulse DP2 in the second print drive signal COM2 is a drive pulse for causing the nozzle 30 to eject ink droplets corresponding to a dot larger than the smallest dot. Such drive pulses are well known, and thus the detailed description of the drive pulses is omitted.

The micro-vibration operations performed by using the micro-vibration drive pulses such as the micro-vibration drive pulse VP1 can be roughly classified into two operations: a so-called in-printing micro-vibration operation that is performed in a print unit cycle in which ink is not ejected from the nozzle during an operation of printing an image or the like; and a so-called non-printing micro-vibration operation that is performed when the electric power of the liquid ejecting apparatus is turned on and no printing operation is performed, that is, in a standby state. The in-printing micro-vibration operation prioritizes the printing stability and thus reduces the overall voltage of the micro-vibration drive pulses and reduces the inclination of potential changes so as to reduce the residual vibration after the micro vibration as low as possible. On the other hand, in the non-printing micro-vibration operation, the effect of stirring is more important than the printing stability, and thus the overall voltage of the micro-vibration drive pulses and the inclination of potential changes are larger than those in the in-printing micro-vibration operation. In addition to the operations, the micro-vibration operation includes a so-called pre-print micro-vibration operation that is performed prior to a transition from a standby state to a printing operation. The printer 1 according to the embodiment performs, in addition to the above-described common micro-vibration operations, an evaporation micro-vibration operation (vibration operation (stirring operation) according to the embodiment) for actively evaporating a solvent such as water in an ink from the nozzles 30 in an environment in which the ink in the internal flow path in the recording head 10 is likely to freeze. Hereinafter, this operation will be described.

Figure 6:
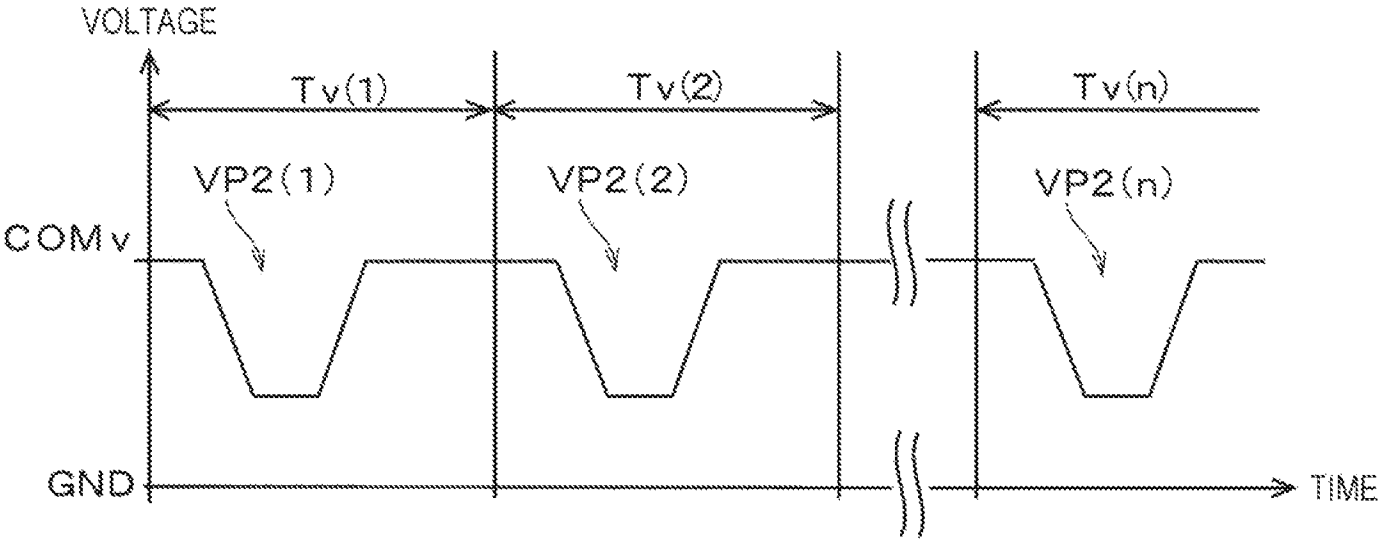
FIG. 6 illustrates an example waveform of a vibration-operation drive signal.

FIG. 6 illustrates an example waveform of a vibration-operation drive signal COMv to be generated by the drive-signal generating circuit 19. The drive-signal generating circuit 19 according to the embodiment generates, in addition to the above-described first print drive signal COM1 and the second print drive signal COM2, the vibration-operation drive signal COMv that is used for the evaporation micro-vibration operation. The vibration-operation drive signal COMv is a drive signal for generating an evaporation micro-vibration drive pulse VP2 (example drive waveform according to the embodiment). The drive-signal generating circuit 19 repeatedly generates the vibration-operation drive signal COMv at every predetermined drive cycle Tv in an evaporation micro-vibration operation.

Figure 7:
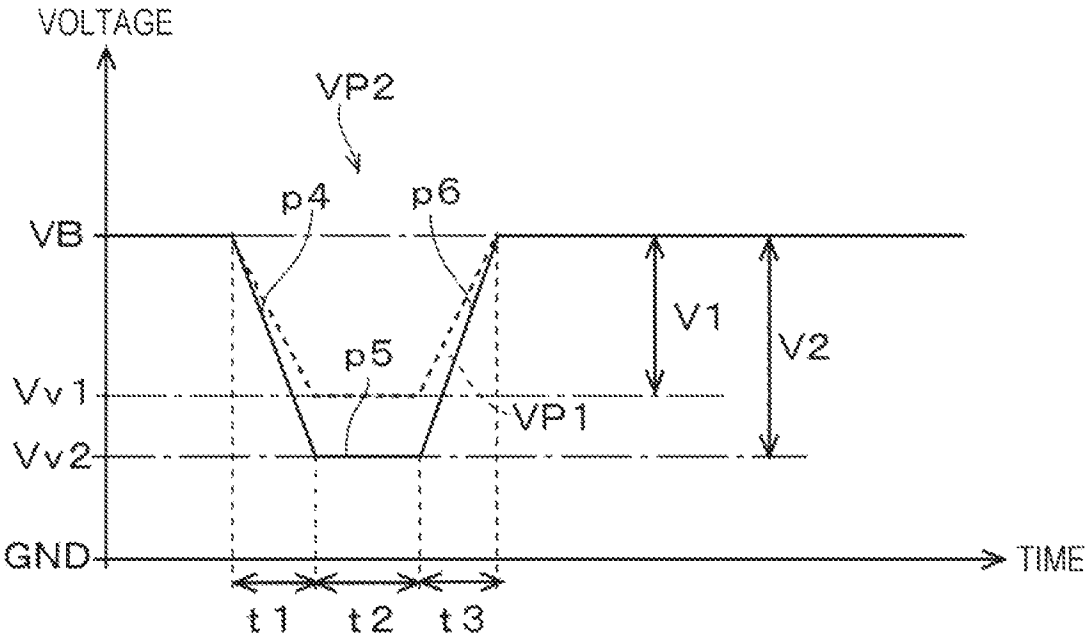
FIG. 7 illustrates an example waveform of an evaporation micro-vibration drive pulse.

FIG. 7 illustrates an example waveform of an evaporation micro-vibration drive pulse VP2. In FIG. 7, the micro-vibration drive pulse VP1 is illustrated by a broken line for comparison. The evaporation micro-vibration drive pulse VP2 is a drive pulse for causing pressure fluctuations in the ink in the pressure chambers 33 to the extent that the ink is not ejected from the nozzles 30 such that the ink in the pressure chambers 33 and the nozzles 30 is vibrated and stirred to promote evaporation of a solvent such as water in the ink in the nozzles 30. The evaporation micro-vibration drive pulse VP2 according to the embodiment has a second expansion element p4, a second hold element p5, and a second contraction element p6. The second expansion element p4 is a waveform element for reducing a potential from the reference potential VB to a second micro-vibration potential Vv2 that is lower than the reference potential VB and the first micro-vibration potential Vv1. The second hold element p5 is a waveform element for maintaining the second micro-vibration potential Vv2 that is a termination potential of the second expansion element p4 for a certain period of time. The second contraction element p6 is a waveform element for increasing a potential from the second micro-vibration potential Vv2 to the reference potential VB.

With respect to an evaporation micro-vibration drive pulse VP2 according to the embodiment, a second micro-vibration drive voltage (that is, a potential difference between the reference potential VB and the second micro-vibration potential Vv2) V2 is larger than a first micro-vibration drive voltage (that is, a potential difference between the reference potential VB and the first micro-vibration potential Vv1) V1 of the micro-vibration drive pulse VP1, and inclinations (that is, potential change rates per unit time) of the second expansion element p4 and the second contraction element p6, which are waveform elements whose potentials change, are larger (that is, steeper) than the inclinations of the first expansion element p1 and the first contraction element p3 of the micro-vibration drive pulse VP1. More specifically, the first micro-vibration drive voltage V1 of the micro-vibration drive pulse VP1 is set to 25% or less of a drive voltage Vd (a potential difference between a maximum potential VH1 and a minimum potential VL1, see FIG. 4) of the first ejection drive pulse DP1, whereas the second micro-vibration drive voltage V2 of the evaporation micro-vibration drive pulse VP2 is set to 25% or more and 50% or less of the drive voltage Vd of the first ejection drive pulse DP1. The inclinations of the second expansion element p4 and the second contraction element p6 are set as large as possible within a range in which the ink is not ejected from the nozzle 30. With respect to the inclinations of the second expansion element p4 and the second contraction element p6, the range in which the ink is not ejected from the nozzle 30 changes in accordance with the micro-vibration drive voltage V2. Accordingly, the inclinations of the second expansion element p4 and the second contraction element p6 are determined in accordance with the micro-vibration drive voltage V2 set as described above. In other words, while the micro-vibration drive voltage V2 is maintained at a constant voltage, a time t1 of the second expansion element p4 and a time t3 of the second contraction element p6 are determined respectively. In the above-described example, with respect to the first micro-vibration drive voltage V1 of the micro-vibration drive pulse VP1 and the second micro-vibration drive voltage V2 of the evaporation micro-vibration drive pulse VP2, the drive voltage Vd of the first ejection drive pulse DP1 is set as a reference. Alternatively, for example, a drive voltage of the second ejection drove pulse DP2 may be set as a reference.

When the evaporation micro-vibration drive pulse VP2 is applied to the piezoelectric element 31, first, by the second expansion element p4, the piezoelectric element 31 deforms from a reference state that corresponds to the reference potential VB toward the outside of the pressure chamber 33, and the pressure chamber 33 expands from a reference volume that corresponds to the reference potential VB to a second micro-vibration expansion volume that corresponds to the second micro-vibration potential Vv2. The second micro-vibration expansion volume becomes larger than the first micro-vibration expansion volume. The expansion state of the pressure chamber 33 is maintained throughout the application period of the second hold element p5. The application period of the second hold element p5, that is, the time t2 is determined such that the second contraction element p6 is applied at a timing of exciting the vibration generated in the ink by the second expansion element p4. Then, by the second contraction element p6, the piezoelectric element 31 deforms toward the inside of the pressure chamber 33, and the pressure chamber 33 returns from the second micro-vibration expansion volume, which corresponds to the second micro-vibration potential Vv2, to the reference volume. As described above, by the expansion of the pressure chamber 33 by the second expansion element p4 and the contraction of the pressure chamber 33 by the second contraction element p6, pressure fluctuations occur in the ink in the pressure chamber 33, thereby the ink in the pressure chamber 33 and the nozzle 30 is stirred. The evaporation micro-vibration drive pulse VP2 according to the embodiment has an increased stirring effect as compared to the first micro-vibration drive pulse VP1.

The evaporation micro-vibration drive pulse VP2 is continuously applied multiple times to the piezoelectric element 31 in drive cycles Tv shorter than cycles in a normal micro-vibration operation to vibrate and stir the ink, and thus a solvent such as water in the ink is evaporated from the nozzle 30. With the operation, the solvent evaporation starts from the vicinity of the nozzle 30 and the ink from which some of the solvent around the nozzle 30 has been evaporated (that is, thickened) flows toward the pressure chamber 33 as a result of ink stirring. The repeated evaporation micro-vibration causes the ink to be thickened from the nozzle 30 side toward the pressure chamber 33 side. In this operation, an application frequency fv (=1/Tv) of the evaporation micro-vibration drive pulse VP2 is set to, for example, 20 kHz or more and 30 kHz or less. When the application frequency fv is less than 20 kHz, the evaporation promoting effect of the solvent such as water in the ink decreases, whereas when the application frequency exceeds 30 kHz, the ink is excessively stirred and the thickening of the ink proceeds more than necessary, and thus after the evaporation micro-vibration operation, when a next printing operation is performed, it is difficult to recover the ejection performance of the nozzle 30. Accordingly, the evaporation micro-vibration operation performed within the range of the above-described application frequencies fv enables efficient evaporation of the solvent such as water in the ink, and thus the ejection performance of each nozzle 30 can be recovered in a next printing operation without problems.

Figure 8:
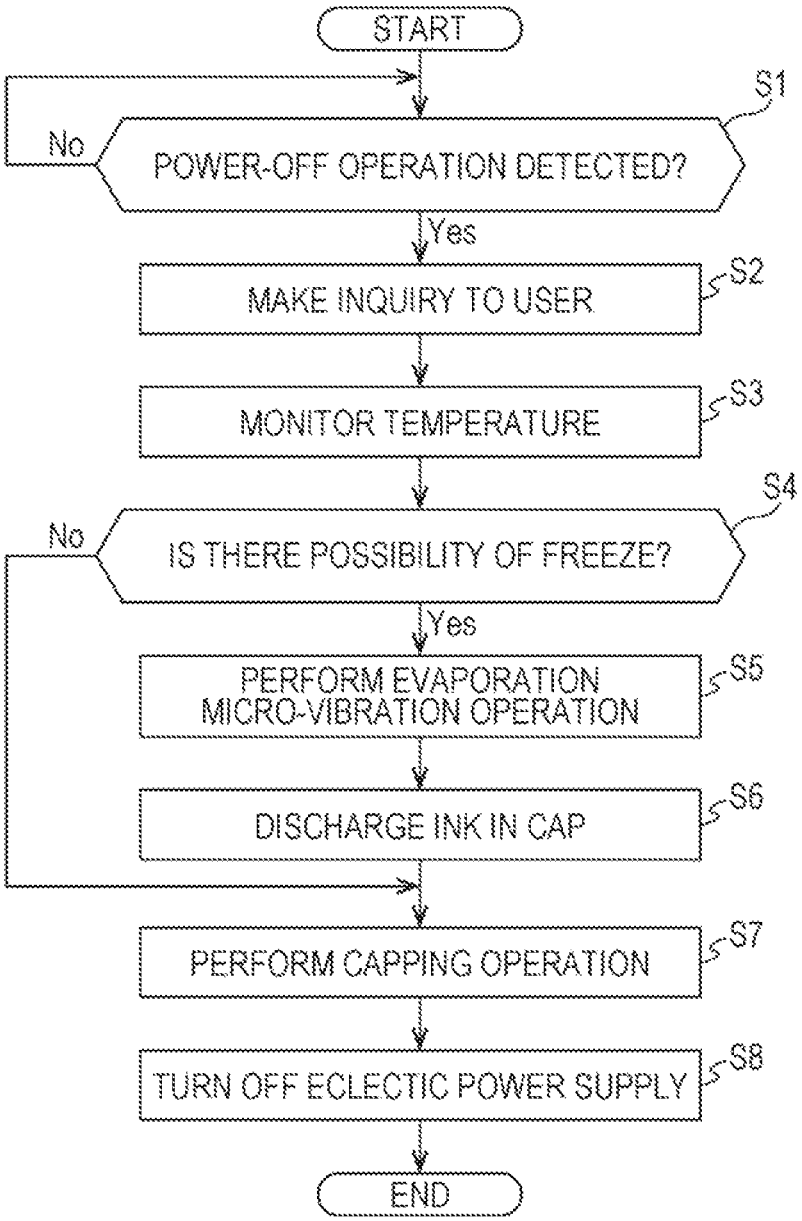
FIG. 8 is a flowchart illustrating a method of controlling a printer relating to an evaporation micro-vibration operation.

FIG. 8 is a flowchart illustrating a method of controlling the printer 1 relating the evaporation micro-vibration operation. In a state in which the electric power of the printer 1 is turned on, the control circuit 17 monitors the button-operation reception section 22 and determines whether a power-off operation for issuing an instruction for turning off the electric power of the printer 1 has been made by a user (off-operation detection process: step S1). When no power-off operation has been detected from the button-operation reception section 22 (No), in step S1, the control circuit 17 continues to monitor the button-operation reception section 22. When the power-off operation has been detected from the button-operation reception section 22 (Yes), the control circuit 17 makes, to the user, an inquiry about information (hereinafter, referred to as storage information as appropriate) on an environment in which the printer 1 is installed via a printer driver or the like executed in an external device that is connected to the printer 1 (step S2). Specifically, the control circuit 17 urges the user to input storage information such as operating conditions of an air conditioner in the room in which the printer 1 is placed with its electric power turned off (for example, whether the printer 1 is placed with a heater turned on or turned off), a period to a next turn-on of the printer 1 (hereinafter, referred to as a shutdown period), or the like. In this operation, options relating to the storage information may be displayed on a display device or the like for the user to select an option from the options.

When the control circuit 17 obtains storage information from the user, the control circuit 17 performs temperature monitoring (temperature information acquisition process: step S3). In the temperature monitoring, temperature information about the temperature in the environment in which the printer 1 is installed is obtained. More specifically, the control circuit 17 obtains an internal temperature (hereinafter, referred to as an apparatus inner temperature) of the printer 1 from the temperature sensor 21 and obtains temperature information such as an outside air temperature from the weather information of the area in which the printer 1 is installed via the Internet or the like. The temperature information includes predicted values of outside air temperature changes over a predetermined period of time (for example, the shutdown period obtained as the storage information) from the day. Based on the storage information and the temperature information, whether there is a possibility of ink freeze in the internal path in the recording head 10 is determined (determination process: step S4). In this process, for example, at the present time (when the temperature monitoring is performed), when the ink is not likely to freeze at the outside air temperature and the apparatus inner temperature but there is a possibility that the outside air temperature decreases to the freezing temperature of the ink while the printer 1 is left under an environment in which the heater is turned off, it is determined that there is a possibility of ink freeze. On the other hand, even if there is a possibility of ink freeze, if the printer 1 is stored under an environment in which the heater is turned on, it is determined that there is no possibility of ink freeze. The determination of the possibility of ink freeze is performed for each ink type because the temperature at which freeze may occur differs depending on the ink type, that is, the composition of the ink.

Based on the storage information and the temperature information, when it is determined that there is no possibility of ink freeze (No), the processes in step S5 and step S6 are not performed and the processing proceeds to the process in step S7. On the other hand, based on the storage information and the temperature information, when it is determined that there is a possibility of ink freeze (Yes), the control circuit 17 performs the evaporation micro-vibration operation (liquid vibration process: step S5). Specifically, the control circuit 17 instructs the carriage-moving mechanism 7 to position the recording head 10 above the capping mechanism 13 such that the nozzle-formed surface of the recording head 10 is separated from the cap 14, and with respect to nozzles 30 that correspond to the ink determined to have the possibility of ink freeze, performs the evaporation micro-vibration operation for vibrating the ink by driving the piezoelectric elements 31 by using the evaporation micro-vibration drive pulse VP2. As a result of the execution of the evaporation micro-vibration vibration operation, the ink in the nozzles 30 and the pressure chambers 33 is vibrated and stirred, and thus the solvent such as water in the ink evaporates. Accordingly, the ink viscosity increases.

The final amount of water in the ink by the evaporation micro-vibration operation is adjusted based on a minimum temperature expected based on the storage information and the temperature information so as not to cause any failure (for example, breakage of the components in the recording head 10 due to expansion at the time of ink freeze) due to ink freeze inside the nozzles 30 and the pressure chambers 33. For example, the evaporation micro-vibration operation is performed, in a case in which the temperature around the recording head 10 is likely to decrease to −10° C., such that the amount of water in the ink becomes 70% or less, and in a case in which the temperature around the recording head 10 is likely to decrease to −15° C., such that the amount of water in the ink becomes 60% or less. The amount of water is adjusted based on the total number of applications of the evaporation micro-vibration drive pulse VP2 to the piezoelectric elements 31 or the execution time of the evaporation micro-vibration operation. Since the amount of water in less than which the ink would not freeze is different depending on the composition of the ink or other factors, the total number of application of the evaporation micro-vibration drive pulse VP2 or the execution time of the evaporation micro-vibration operation is set to a value that corresponds to the composition of the ink or other factors.

After the evaporation micro-vibration operation has been performed, the control circuit 17 activates the pump unit 16 to suck and discharge the ink remaining in the cap 14 to a waste liquid tank (not illustrated) (step S6). With this operation, the discharging of the ink in the cap 14 before the capping operation to the nozzle-formed surface of the recording head 10 reduces faults due to water evaporated from the ink adhering to the cap 14 into the sealed space after the capping. Specifically, it can be prevented that the water evaporated from the ink adhering to the cap 14 into the sealed space after the capping mixes with the ink in the nozzles 30, the amount of water in the nozzles 30 and the pressure chambers 33 increases, and the ink freezes, and it can be prevented that the water enters the space between the cap 14 and the nozzle-formed surface and freezes. After the discharging of the ink in the cap 14, the control circuit 17 controls the capping mechanism 13 to perform capping by using the cap 14 to the nozzle-formed surface of the recording head 10 (sealing process: step S7), and turns off the electric power of the printer 1 (step S8).

Figure 9:
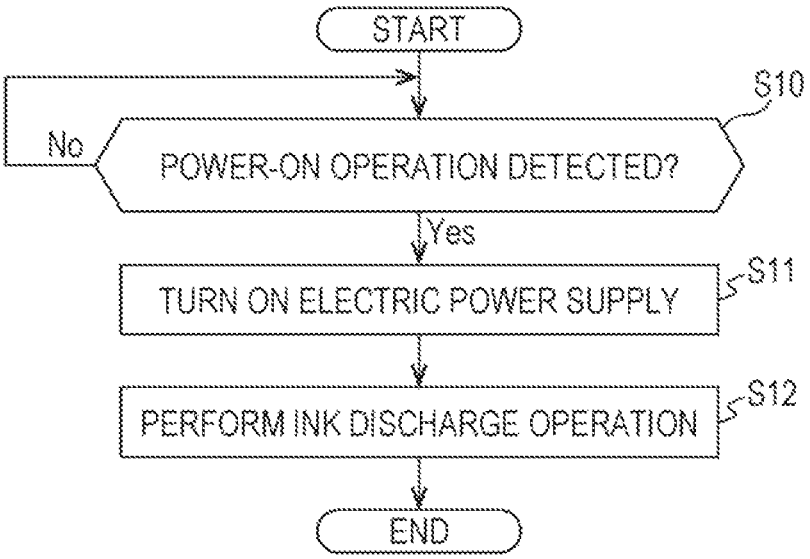
FIG. 9 is a flowchart illustrating processing to be performed when an electric power supply is turned on after an evaporation micro-vibration operation and power shutdown of the printer.

FIG. 9 is a flowchart illustrating processing to be performed when an electric power of the printer 1 is turned on again after the evaporation micro-vibration operation and power shutdown of the printer 1. The control circuit 17 monitors the button-operation reception section 22 and determines whether a power-on operation for issuing an instruction for turning on the electric power of the printer 1 has been made by a user (on-operation detection process: step S10). When no power-on operation has been detected from the button-operation reception section 22 (No), in step S10, the control circuit 17 continues to monitor the button-operation reception section 22. When a power-on operation has been detected from the button-operation reception section 22 (Yes), the control circuit 17 turns on the electric power of the printer 1 (step S11). Then, the control circuit 17 performs an operation to discharge the ink, whose water is evaporated and thickened by the evaporation micro-vibration operation, from the nozzles 30 (liquid discharge process: step S12). More specifically, in a capping state in which the nozzle-formed surface is sealed by the cap 14, the control circuit 17 activates the pump unit 16 to discharge the thickened ink in the nozzles 30 and the pressure chambers 33 from the nozzles 30 into the cap 14 and discharges the ink into the waste liquid tank (not illustrated). In this operation, the ink flow path including the nozzles 30 and the pressure chambers 33 in the recording head 10 is filled with a new ink from the ink cartridge 8, and thus the ink in the nozzles 30 and the pressure chambers 33 is not replaced with air. By the processing, the ink whose water is evaporated and thickened by the evaporation micro-vibration operation is discharged from the recording head 10, and the ink ejection performance of the nozzles 30 can be recovered. Accordingly, in the subsequent printing operation, an occurrence of a fault in the ejection operation can be prevented. Note that the ink discharge operation is not limited to the operation of sucking the ink from the nozzles 30, for example, an operation of driving the piezoelectric elements 31 to eject the ink from the nozzles 30, a so-called flushing operation, may be employed or these operations may be combined. When the electric power of the printer 1 is turned off and then turned on next without the evaporation micro-vibration operation, such a forcible ink discharge from the nozzles may be omitted. This is because when the electric power is turned off without the evaporation micro-vibration operation, the viscosity of the ink in the nozzles is not increased so much and in such a case, printing may be immediately performed.

As described above, in an environment in which ink freeze may occur, the evaporation micro-vibration operation is performed in response to a power-off instruction to the printer 1, and thereby water in the ink in the ink flow path is evaporated. Accordingly, even when the printer 1 is stored in a low temperature environment with the electric power being actually turned off, ink freeze in the recording head 10 can be reduced. As a result, damage to the components of the recording head 10 due to the expansion caused by the ink freeze can be reduced. Furthermore, no dedicated mechanism for evaporating water in the ink is not required, and an increase in size and complication of the apparatus can be prevented. Furthermore, since the ink in the nozzles 30 and the pressure chambers 33 is not replaced with air, mixing of air bubbles in the ink can be prevented. It is not always necessary to evaporate a solvent such as water in the entire ink, that is, to thicken the entire ink in the pressure chambers 33. This is because the ink in the nozzles 30 is not likely to freeze as long as water in the ink in portions, particularly, like the nozzle plate 24, near portions in contact with the outside air is evaporated and thickened. Even if the ink in the pressure chambers 33 freezes and expands, the unfrozen ink in the above portions can move in the expanded areas (the unfrozen ink serves as a buffer material), and thus a fault caused by freeze can be reduced. In this embodiment, when a power-off operation has been detected and a condition in which ink freeze may occur is satisfied based on temperature information, the evaporation micro-vibration operation (liquid vibration process) is performed, and thus unnecessary evaporation micro-vibration operation can be prevented. Furthermore, the nozzle-formed surface is sealed with the cap 14 after the evaporation micro-vibration operation, and thereby the state in which water in the ink is evaporated by the evaporation micro-vibration operation can be maintained until the electric power is turned on next. The sealing with the cap 14 reduces excessive thickening of the ink until the electric power is turned on next.

In the above-described first embodiment, the electric power is turned off after the evaporation micro-vibration operation; however when the electric power is not turned off, ink freeze in the recording head 10 under a low temperature condition can be reduced by sealing the nozzle-formed surface with the cap 14 without ejecting the ink from the nozzles 30 after the evaporation micro-vibration operation. Furthermore, although an inquiry about the storage information is made to a user when a power-off operation has been detected in the above-described first embodiment, the inquiry to a user may not always be performed. In such a case, a possibility of freeze can be automatically determined based on the temperature information that is a result of temperature monitoring.

Figure 10:
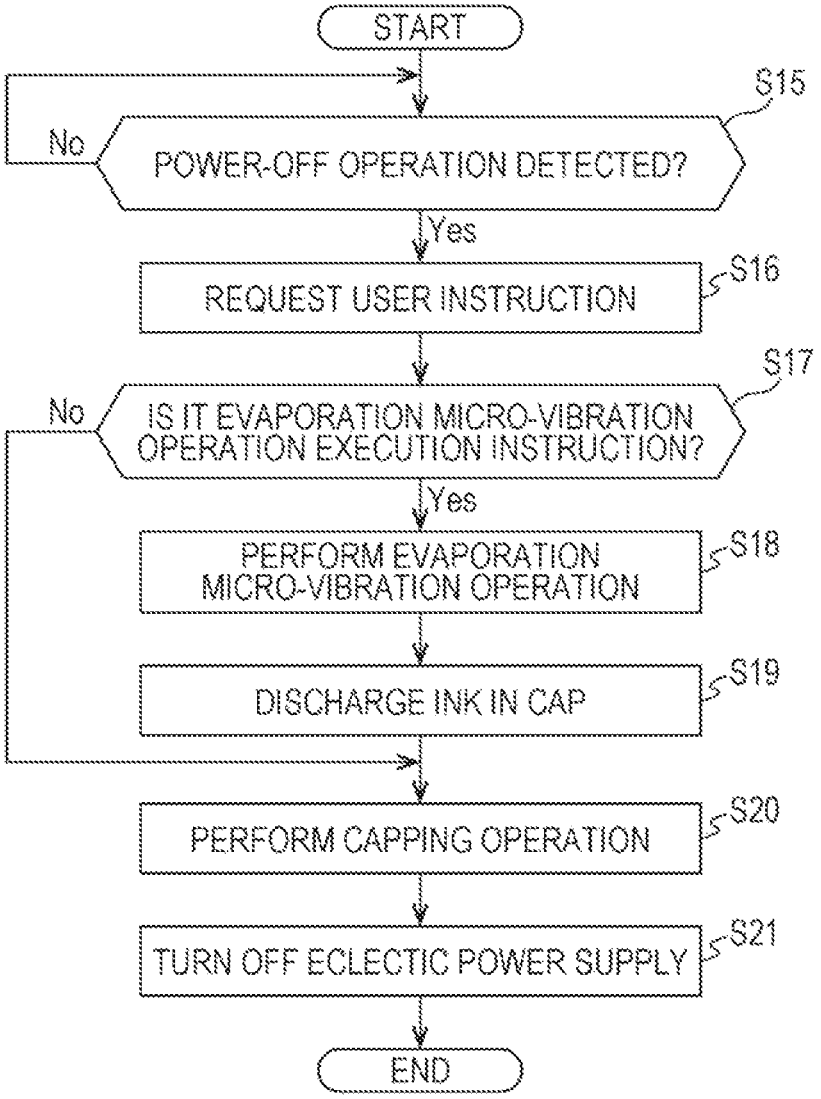
FIG. 10 is a flowchart illustrating a method of controlling a printer relating to an evaporation micro-vibration operation according to a second embodiment.

FIG. 10 is a flowchart illustrating a method of controlling the printer 1 relating to an evaporation micro-vibration operation according to another embodiment. In the above-described first embodiment, temperature information is obtained, and a possibility of ink freeze is determined based on the temperature information, and then the evaporation micro-vibration operation is performed; however, the example of the evaporation micro-vibration operation is not limited to this example. This embodiment differs from the above-described first embodiment in that the evaporation micro-vibration operation is performed without obtaining temperature information when an instruction for executing the evaporation micro-vibration operation is issued by a user. Specifically, in a state in which the electric power of the printer 1 is turned on, the control circuit 17 monitors the button-operation reception section 22 and determines whether a power-off operation for issuing an instruction for turning off the electric power of the printer 1 has been made by a user (off-operation detection process: step S15). When no power-off operation has been detected from the button-operation reception section 22 (No), in step S15, the control circuit 17 continues to monitor the button-operation reception section 22. When a power-off operation has been detected from the button-operation reception section 22 (Yes), the control circuit 17 requests to the user an instruction to perform or not to perform the evaporation micro-vibration operation via a printer driver or the like executed in an external device that is connected to the printer 1 (instruction request process: step S16). More specifically, the printer 1 requests the user to determine whether there is a possibility of ink freeze in a state in which the electric power is turned off, and receives from the user an instruction to perform or not to perform the evaporation micro-vibration operation based on the determination. In this process, options corresponding to the determination of executing the evaporation micro-vibration operation and the determination of not executing the evaporation micro-vibration operation may be displayed on a display device or the like for the user to select an option from the options.

Then, whether an instruction from the user is an instruction for executing the evaporation micro-vibration operation or not is determined (step S17). When the instruction from the user is an instruction for not executing the evaporation micro-vibration operation (No), the processes in step S18 and step S19 are not performed, and the processing proceeds to the process in step S20. On the other hand, when the instruction from the user is an instruction for executing the evaporation micro-vibration operation (Yes), the control circuit 17 executes the evaporation micro-vibration operation similarly to the above-described first embodiment (liquid vibration process: step S18). The execution of the evaporation micro-vibration operation vibrates and stirs the ink in the nozzles 30 and the pressure chambers 33 and thus water in the ink evaporates. The processes in steps S19 to S21 are similar to those in steps S6 to S8 in the first exemplary embodiment, and accordingly, the descriptions of the processes are omitted.

In this embodiment, similarly to the above-described first embodiment, even when the printer 1 is stored in a low temperature environment in a state in which the electric power is turned off, ink freeze in the recording head 10 can be reduced. As a result, damage to the components of the recording head 10 due to expansion caused by the ink freeze can be reduced. In this embodiment, when an execution instruction is issued by a user, the evaporation micro-vibration operation is performed, and thus unnecessary evaporation micro-vibration operation can be prevented.

Although a so-called flexible vibration piezoelectric element 31 has been exemplified as a drive element in the above-described embodiment, embodiments are not limited thereto. For example, a so-called longitudinal vibration piezoelectric element may be employed. Furthermore, the drive element is not limited to the piezoelectric element; alternatively, the drive element may be a drive element that can vibrate and stir a liquid in the pressure chamber and the nozzle, such as an electrostatic actuator, a heat generation element, or the like.

In the above-described embodiments, as the drive waveforms used for the evaporation micro-vibration operation, in addition to the micro-vibration drive pulse VP1 that is used for a normal micro-vibration operation such as the in-printing micro-vibration operation, the dedicated evaporation micro-vibration drive pulse VP2 is used; however, the drive waveforms are not limited thereto. For example, the micro-vibration drive pulse VP1 that is used for a normal micro-vibration operation may be used as the evaporation micro-vibration operation drive pulse for the evaporation micro-vibration operation. In such a case, the application frequency of the micro-vibration drive pulse VP1 for the piezoelectric element 31 in the evaporation micro-vibration operation may be set to an appropriate frequency for further efficient evaporation of the solvent in the ink. Furthermore, as the vibration drive waveform used for the evaporation micro-vibration operation, a waveform in which a potential change direction, that is, the vertical direction (polarity) is reversed from that of the example evaporation micro-vibration drive pulse VP2 may be employed. In the above-described embodiments, when the evaporation micro-vibration operation (liquid vibration process: step S5 or S18) is performed in the method (flowchart illustrated in FIG. 8 or FIG. 10) of controlling the printer 1 relating to the evaporation micro-vibration operation, the information that indicates that the evaporation micro-vibration operation has been performed may be stored in the storage device 18. In such a case, in the process (flowchart illustrated in FIG. 9) that is performed after the evaporation micro-vibration operation, turning off the electric power of the printer 1, and turning on the electric power next, after turning on the electric power of the printer 1 (step S11), whether the information indicating that the evaporation micro-vibration operation has been performed is stored in the storage device 18 is determined. When the information indicating that the evaporation micro-vibration vibration operation has been performed is not stored in the storage device 18, the process may be ended without performing the operation (liquid discharge process: step S12) of discharging the ink, whose water has been evaporated and thickened by the evaporation micro-vibration operation, from the nozzles 30. On the other hand, when the information indicating that the evaporation micro-vibration operation has been performed is stored in the storage device 18, the operation to discharge the ink, whose water is evaporated and thickened by the evaporation micro-vibration operation, from the nozzles 30 (liquid discharge process: step S12) is performed, the information indicating that the evaporation micro-vibration has been performed is deleted from the storage device 18, and the process may be ended. Furthermore, when a time from an execution of the evaporation micro-vibration operation and a power-off operation (step S8 or S21) to a next power-on operation is measured and the information indicating that the evaporation micro-vibration has been performed is not stored in the storage device 18, if the measured time is greater than or equal to a predetermined period, the liquid discharge process (step S12) may be performed. When a time from an execution of the evaporation micro-vibration operation and a power-off operation (step S8 or S21) to a next power-on operation is measured and the information indicating that the evaporation micro-vibration has been performed is stored in the storage device 18, the power for discharging the thickened ink in the nozzles 30 and the pressure chambers 33 into the cap 14 in the liquid discharge process (step S12), that is, the suction force, the operation time, or the like may be increased as the measured time becomes longer.

Although the recording head 10, which is an example liquid ejecting head, has been described in the above-described embodiments, embodiments of the disclosure are applicable to other liquid ejecting heads having components that may be damaged by liquid freeze and liquid ejecting apparatuses having the liquid ejecting heads. For example, embodiments of the disclosure may be applicable to liquid ejecting heads each having a plurality of color material ejecting heads to be used to manufacture color filters for liquid crystal displays or the like, electrode material ejecting heads to be used to form electrodes for organic electro luminescence (EL) displays, field emission displays (FEDs), or the like, or bioorganic substance ejecting heads to be used to manufacture biochips (biochemical elements), or may be applicable to liquid ejecting apparatuses having any of these heads.

What is claimed is:

1. A method of controlling a liquid ejecting apparatus that includes a liquid ejecting head having nozzles configured to eject a liquid and drive elements configured to generate pressure fluctuations in liquid chambers communicating with the nozzles, the method comprising:

detecting a power-off operation for issuing an instruction for turning off an electric power of the liquid ejecting apparatus; and driving the drive elements to the extent the liquid is not ejected from the nozzles in response to detecting the power-off operation by the detecting.

2. The method of controlling the liquid ejecting apparatus according to claim 1, wherein after the driving, performing the power-off operation without ejecting or discharging the liquid from the nozzles.

3. The method of controlling the liquid ejecting apparatus according to claim 1, wherein performing the driving without sealing openings of the nozzles, and after the driving, sealing the openings of the nozzles, and performing the power-off operation.

4. The method of controlling the liquid ejecting apparatus according to claim 1, wherein in response to detecting the power-off operation by the detecting, acquiring temperature information on an environment in which the liquid ejecting apparatus is installed; and determining whether to perform or not to perform the driving based on the acquired temperature information.

5. The method of controlling the liquid ejecting apparatus according to claim 1, wherein in response to detecting the power-off operation by the detecting, requesting a user to input environment information on an environment in which the liquid ejecting apparatus is installed; and determining whether to perform or not to perform the driving based on the environment information input by the user.

6. The method of controlling the liquid ejecting apparatus according to claim 1, wherein after the power-off operation, when a power-on operation for issuing an instruction for turning on the electric power is detected, in a case in which the driving has been performed and then the power-off operation has been performed, forcibly discharging the liquid from the nozzles, and in a case in which the power-off operation has been performed without the driving, not forcibly discharging the liquid from the nozzles.

7. A liquid ejecting apparatus comprising:

a liquid ejecting head having nozzles configured to eject a liquid and drive elements configured to generate pressure fluctuations in liquid chambers communicating with the nozzles, wherein the drive elements are driven to the extent that the liquid is not ejected from the nozzles in response to detection of a power-off operation for issuing an instruction for turning off an electric power of the liquid ejecting apparatus.

* * * * *